United States Patent [19]

Young

[11] 4,402,505

[45] Sep. 6, 1983

[54] TRUNK EXERCISING DEVICE

[76] Inventor: Sidney P. Young, Rte. 2, Box 488, Halifax, Va. 24558

[21] Appl. No.: 290,216

[22] Filed: Aug. 5, 1981

[51] Int. Cl.[3] ..... A63B 23/02

[52] U.S. Cl. ..... 272/130; 272/143

[58] Field of Search ..... 272/93, 116, 130, 132, 272/138, 139, 134, 143

[56] References Cited

U.S. PATENT DOCUMENTS

| | | | |
|---|---|---|---|
| 1,257,957 | 2/1918 | Kost | 272/130 |
| 2,469,301 | 5/1949 | Johnston | 272/93 X |
| 3,012,776 | 12/1961 | Hotas | 272/58 |
| 3,802,701 | 4/1974 | Good | 272/138 |
| 4,066,259 | 1/1978 | Brentham | 272/130 X |
| 4,204,676 | 5/1980 | Givens | 272/136 |
| 4,227,689 | 10/1980 | Keiser | 272/130 |
| 4,240,627 | 12/1980 | Brentham | 272/130 |
| 4,278,249 | 7/1981 | Forrest | 272/132 |

OTHER PUBLICATIONS

"Physical Examination of the Spine and Extremities"; author—Stanley Hoppenfeld; p. 249.

*Primary Examiner*—Richard J. Johnson

*Attorney, Agent, or Firm*—Martin P. Hoffman; Mitchell B. Wasson; Charles W. Fallow

[57] ABSTRACT

An exercising device for strengthening the trunk muscles of a human being. The device comprises, inter alia, a frame that is permanently attached to a support surface, and a yoke that is secured to a support arm on the frame. A pair of resistance elements, preferably hydraulic cylinders, are mounted between the frame and the yoke, one cylinder being secured on each side of the centrally situated support arm. The yoke is adjusted to fit about the upper trunk of the user, and the user twists his trunk to pivot the yoke about the support arm against the resistance provided in a horizontal plane by the hydraulic cylinders. A stabilizer bar prevents the hips of the user from rotating while using the exercise device.

7 Claims, 5 Drawing Figures

TRUNK EXERCISING DEVICE

BACKGROUND OF THE INVENTION (1) Field of the Invention

The instant invention pertains generally to exercising devices for strengthening the trunk muscles of a human being, and more particularly to an exercising device that operates on a trunk twisting concept.

(2) Description of the Prior Art

Exercising machines for strengthening the trunk, or torso, of the human body are known, as, for example, the exercising machine disclosed in U.S. Pat. No. 3,012,776, granted Dec. 12, 1961 to Leon G. Hotas. Such machine comprises a table 22, a platform 30 pivotally supported from the table for swinging movement, a pulley 31 rotatable on the platform, a manual control 48 for releasably locking the platform to the pulley for joint rotation, and a lifting cable 37 that normally has a weight at one end. The possible end of the cable is windable about the pulley. Backing plates 61 retain a recumbent patient on the platform with the abdominal joints of the patient extending over the pivoted support. By connecting the platform to different positions on the pulley 31, the patient can operate the machine by either pushing or pulling the weights. The rehabilitative aspects of this exercise device are discussed in column 3, line 67–column 4, line 34, and the suggestion that the same exercising device may be used to develop torso muscles for athletes is noted at column 4, lines 35–37.

While the torso exercising device disclosed by Hotas may be well suited for assisting in the rehabilitation of patients with severe spinal and back injuries, such device, which must be used in a supine position, is too bulky, cumbersome, and complex for use in a gymnasium or other athletic training facility. Furthermore, the Hotas device is not suited for developing, or at last toning, all of the several different groups of muscles that are situated about the human spine.

SUMMARY

Consequently, the instant invention contemplates an exercising device composed of a reduced number of components a simplified design so that the exercising device may function satisfactorily for an extended period of time with but minimal maintenance. Furthermore, the instant exercising device strengthens the trunk muscles, specifically the obliquus externus abdominus and the obliquus internus abdominus (which frequently contribute to so-called middle age bulge or sag), the erector spinae and the deep spinal muscle groups of the back.

These salutary objectives are realized in an exercising device that operates on a trunk twisting principle to achieve exceptional rotational strength in the human trunk.

The trunk twisting principle is incorporated into an exercising machine which comprises a frame that is permanently attached to a support surface, and a yoke that is secured to a centrally located support arm on the frame. Two resistance elements, such as hydraulic cylinders, are secured between the frame and the yoke, one cylinder being positioned equidistant from the support arm on opposite sides thereof. The yoke, which has a chest receiving cavity defined therein, is readily adjustable to fit about the trunk of the user. The user twists his trunk to pivot the yoke about the support arm against the resistance provided by the hydraulic cylinders. A stabilizer bar is provided so that rotation of the hips of the user is minimized, and the effectiveness of the device is increased. The user may perform as many sets and repetitions as his conditioning regimen dictates.

Other advantages of the instant exercising device will become readily apparent to the skilled artisan from a perusal of the attached drawings and the ensuing specification.

DESCRIPTION OF THE PREFERRED EMBODIMENT

Figure 1:
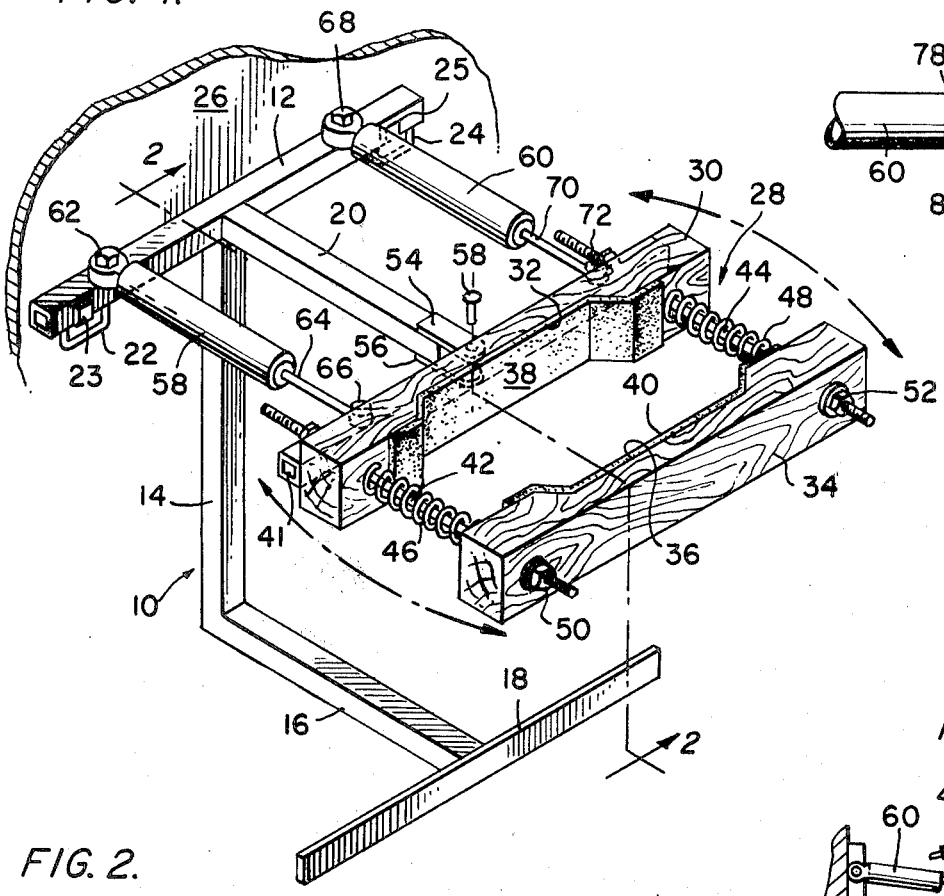
FIG. 1 is a perspective view of an exercising device embodying the principles of the instant invention.

Turning not to the drawings wherein identical reference numerals are used to identify the identical member, FIG. 1 shows an exercising device 10 constructed in accordance with the principles of the instant invention. The exercising device 10 includes a C-shaped frame, when viewed in side elevation. The frame including a mounting arm 12, a vertically extending post 14 secured perpendicular to arm 12, and a lower support arm 16. A stabilizer bar 18 is secured to the free end of arm 16, and an upper support arm 20 extends away from the midpoint of arm 12 in a direction parallel to arm 16. Hand grips 22,24 are provided near the opposite ends of the mounting arm 12 to facilitate handling the frame. Arms 12 and post 14 are anchored, as by bolts 23,25, to a support surface 26 in a known manner.

A yoke, indicated generally by reference numeral 28, is secured to the free end of upper support arm 20. Yoke 28 comprises a first wooden beam 30 with a chest receiving cavity 32 defined therein, and a second wooden beam 34 with a back receiving cavity 36 defined therein. A foam insert 38 covers the surface of cavity 32, and a similar insert 40 covers the surface of cavity 36. A rectangular metal channel 41 extends along one face of beam 30 and the channel is bolted to the beam.

A first threaded bolt 42 and a second threaded bolt 44 extend through holes drilled through beams 30,34 and channel 41 to retain the beams in alignment. Coil springs 46,48 are slipped over the bolts to urge the beams apart, so that the user can position himself within the yoke 28. The spacing between the beams 30,32 can be adjusted by tightening the nuts 50,52 on the bolts 42,44 in opposition to the bias of springs 46,48.

A first ear 54 is welded to the upper surface of the free end of support arm 20, and a second, matching ear 56 is welded to the lower surface of the free end of support arm 20. The forwardly projecting surfaces of ears 54,56 are curved, and a hole is formed in each ear. The holes are aligned so that a sturdy pin 58 can be inserted through the hole in ear 54, through holes drilled in the top and bottom surfaces of channel 41, and thence through the hole in ear 56.

A first and a second resistance element, such as hydraulic shock absorbers 58,60, respectively, are connected between the mounting arm 12 and the channel 41 of the yoke 28. One end of the cylindrical body of the shock absorber 58 is secured to arm 12 by fastener 62, while the free end of the piston 64, which moves relative to the cylindrical body, is secured to channel 41 by fastener 66. Similarly, one end of the cylindrical body of the shock absorber 60 is secured to arm 12 by fastener 68, while the free end of the piston 70, which moves relative to the cylindrical body, is secured to channel 41 by fastener 72.

Figure 2:
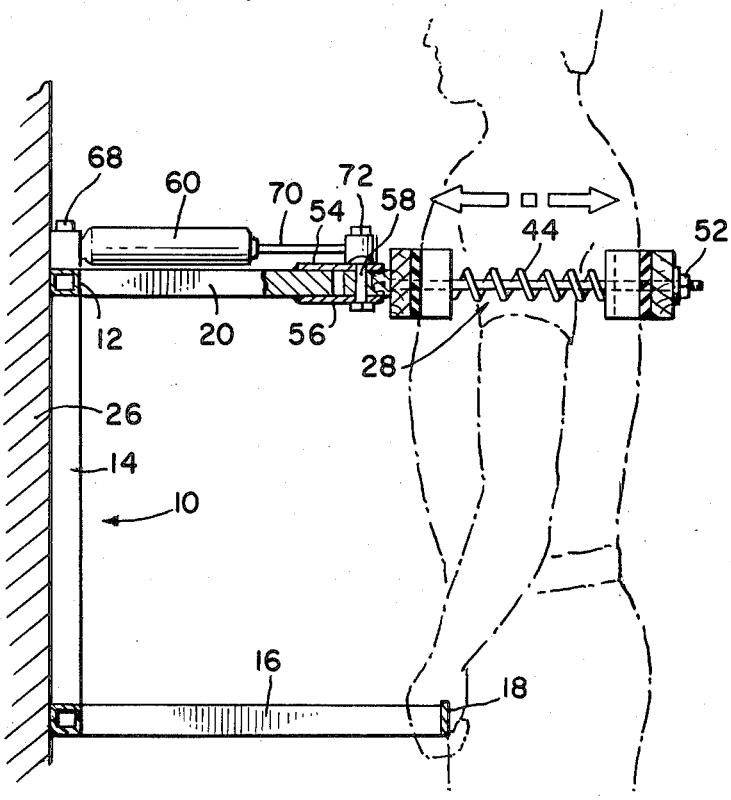
FIG. 2 is a side elevational view of the exercising device, such view being taken along line 2—2 in FIG. 1 and in the direction indicated.

FIG. 2 suggests that the user positions his chest within the yoke 28 so that his chest fits within cavity 32. The yoke is then tightened by advancing nuts 50,52 along bolts 42,44, respectively. The nuts are advanced against the biasing forces exerted by springs 46,48, which tend to urge the yoke to an opened position.

Figure 3:
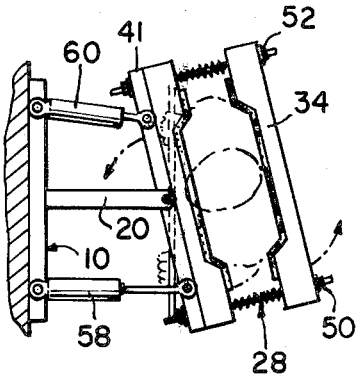
FIGS. 3 and 4 are top plan views, on a reduced scale, showing the manner in which a person operates the exercising device.
Figure 4:
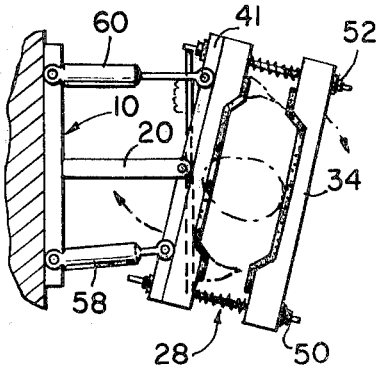

The user then grasps stabilizer bar 18 and rotates his trunk within yoke 28 in a counterclockwise direction against the resistance offered by hydraulic shock absorber 60, as shown in FIG. 3. Subsequently, the user rotates his trunk within yoke 28 in a clockwise direction against the resistance offered by hydraulic shock absorber 58, as shown in FIG. 4. The yoke pivots about support arm 20, which is secured to the midpoint of channel 41 that is secured to one surface of yoke 28. The stabilizer bar prevents or limits rotation of the hips of the user, thus isolating the abdominal and erector muscles during the exercises.

Figure 5:
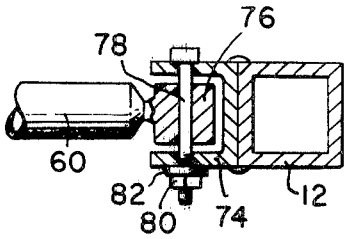
FIG. 5 is a side elevational view, on an enlarged scale, showing an alternative manner for joining a resistance element to the frame of the exercising machine.

While the hydraulic shock absorbers 58,60 shown in the preferred embodiment of FIGS. 1–4 are mounted in a generally horizontal plane by fasteners extending through arm 12 and channel 41, FIG. 5 depicts a modified mounting arrangement. A C-shaped bracket 74 is secured to the inner face of arm 12, and an enlarged head 76 is formed at the end of the shock absorber 60. A threaded bolt 78 extends through bracket 74 and through an aperture in the head 76 of the shock absorber 60, and a nut 80 and washer 82 are positioned on the lower end of the bolt. By tightening the nut 80, the shock absorber is firmly secured in place. The alternative mounting arrangement shown in FIG. 5 insures that the hydraulic shock absorbers will lie in a substantially horizontal plane for maximum effectiveness. A similar C-shaped bracket (not shown) may be secured to the inner face of channel 41 to receive the free end of piston 70, if so desired.

The preferred embodiment of the invention, shown in FIGS. 1–4, has been described in full, clear and concise terms. An alternative mounting arrangement has been shown in FIG. 5. Further modifications could be made to the instant invention without departing from the trunk twisting principle embodied therein; for example, the hydraulic shock absorbers 58,60 could be replaced by known hydraulic door closers or by springs that could provide the necessary resistance to trunk movement. Also, the exercising device might be designed to be a free standing unit that need not be anchored or otherwise secured to a fixed support surface, such as a wall. Alternatively, the frame might be clamped about a rigid column which could serve as a support surface. Obviously, other refinements and modifications may occur to the skilled artisan without departing from the teachings embraced in this application. Consequently, the appended claims should be liberally construed, in a manner consistent with the spirit of this invention, and should not be limited to their exact, literal terms.

I claim:

1. An exercising device for strengthening and toning the human torso, said device comprising:

(a) a frame adapted to be secured to a supporting surface, (b) said frame including a horizontally extending mounting arm, a vertically extending post, and a lower support arm, (c) said frame further including an upper support arm projecting parallel to said lower support arm and perpendicular to said mounting arm, (d) a yoke adapted to receive the trunk of a human being using said device, (e) said yoke comprising a first beam with a chest receiving cavity defined therein and a second beam with a back receiving cavity defined therein, (f) means for securing said yoke to said upper support arm so that said yoke can be pivoted thereabout in a horizontal plane, and (g) resistance means secured between said mounting arm and said yoke, said resistance means opposing the pivotal movement of said yoke about said support arm.

2. An exercising device as defined in claim 1 wherein a stabilizer bar is formed at the free end of the lower support arm, said bar preventing rotation of the hips while using the exercise device.

3. An exercising device as defined in claim 1 wherein threaded bolts extend through holes in each beam to retain the yoke in alignment, and nuts are adjusted along said bolts to move the beams relative to each other.

4. An exercising device as defined in claim 3 wherein coil springs are positioned along each bolt, said springs providing a biasing force that urges the beams away from each other.

5. An exercising device as defined in claim 1 wherein a channel is secured to one face of said first beam, and a first ear is secured to the upper surface of said support arm and a second ear is secured to the lower surface of said support arm, and a pin extends vertically through aligned holes in said ears and said channel to join said yoke to said support arm.

6. An exercising device as defined in claim 1 wherein means are provided to secure said resistance means in a horizontal plane.

7. An exercising device as defined in claim 6 wherein said means for securing the resistance means in a horizontal plane includes a C-shaped bracket secured to one face of said mounting arm.

* * * * *